US006981891B1

(12) United States Patent
Huang

(10) Patent No.: US 6,981,891 B1
(45) Date of Patent: Jan. 3, 2006

(54) FLEXIBLE FLAT CABLE CONNECTOR

(76) Inventor: Alex Huang, 235 Chung - Ho, Box 8-24, Taipei (TW)

( * ) Notice: Subject to any disclaimer, the term of this patent is extended or adjusted under 35 U.S.C. 154(b) by 0 days.

(21) Appl. No.: 10/967,840

(22) Filed: Oct. 19, 2004

(51) Int. Cl.
*H01R 12/24* (2006.01)

(52) U.S. Cl. ..... 439/497

(58) Field of Classification Search ..... 439/497, 439/327, 492, 495, 578–579, 596, 607
See application file for complete search history.

(56) References Cited

U.S. PATENT DOCUMENTS 4,589,715 A * 5/1986 Weisenburger ..... 439/77
4,640,562 A * 2/1987 Shoemaker ..... 439/77
5,980,308 A * 11/1999 Hu et al. ..... 439/497
6,743,045 B1 * 6/2004 Hayashi et al. ..... 439/495
6,793,527 B2 * 9/2004 Noro ..... 439/579

* cited by examiner

*Primary Examiner*—J. F. Duverne

(57) ABSTRACT

A flexible flat cable connector, for electrically engaging a socket having an upper terminal and a lower terminal, comprises an insulating member having an indentation and an adjacent retaining block on each of two lateral sides thereof and a multitude of spring finger slots along the front edge thereof; a base plate mounted on the insulating member having two projected ears respectively on two lateral sides, each extended into a corresponding indentation, each projected ear having a retaining hole for retaining a corresponding retaining block, and a multitude of spring fingers contained within the spring finger slots; and an upper plate slidably connected to the insulating member for covering the base plate having two side walls for holding the insulating member, each of the side walls being provided with a resilient arm in electric contact with a corresponding projected ear and extended into a corresponding indentation.

9 Claims, 9 Drawing Sheets

A-A

B–B

FLEXIBLE FLAT CABLE CONNECTOR

FIELD OF THE INVENTION

The present invention relates to flexible flat cable connectors, more particularly to a flexible flat cable connector for transmitting electric signals between a flexible flat cable and a socket.

BACKGROUND OF THE INVENTION

An electronic appliance contains inner places where electric signals are transmitted from one part to another. The means for such connection uses electric connectors or a flexible flat cable connected with a flexible flat cable connector.

Refer to FIG. 1, a socket 1 for receiving a flexible flat cable connector of the prior art is illustrated. The socket 1 comprises a housing 11 with a metallic outer shell, an upper terminal 12 located on the upper inner wall of the housing 11 and a lower terminal 13 located on the lower inner wall of the housing 11. The upper and lower terminals 12, 13 respectively have connective members 121 and 131, which are metallic strips bulged into each other.

Referring to FIG. 1, a mating member 2 of the prior art, which can be coupled with the socket 1, includes an insulating member 21, an upper plate 22 on the top side of the insulating member 21 and a base plate 23 on the bottom side of the insulating member 21. Between one of the upper plate 22 and the base plate 23 and the insulating member 21, there is adhered a flexible flat cable 3, whereby a mating portion 31 of the flexible flat cable 3 can extend out of the connector 2.

The flexible flat cable 3 is covered with a conductive meshed layer 32 made of silver for reduction of EMI disturbances by being in electric contact with the metallic upper plate 22 or base plate 23. However, the adhesive means for connecting the flexible flat cable 3 with the upper plate 22 or the base plate 23 prohibits an effective electric contact and cannot lessen EMI disturbances. It is a further disadvantage that the adhesive glue material may even cause faults of electric contact. Secondly, the same terminal of the flexible flat cable 3 is provided with a pull plate 33 for facilitating insertion of the connector 2 thereof into the socket 1, However, the pull plate 33 is made of soft plastic and therefore easy to assist the insertion of the connector into the socket 1 but not easy to apply force thereon to unplug the connector 2 from the socket 1. In the third place, the mating portion 31 of the flexible flat cable 3 is designed to be in electric contact with the upper plate 22 or the base plate 23 for a grounding effect. However, this effect may be lost due to the adhesive means for connection. Finally, the upper plate 22 and the base plate 23 are attached onto the insulating member 21 by engagement of only two ends thereof. Such connection cannot provide a sufficient structural force for a solid connection, which may leads to faulted connections.

SUMMARY OF THE INVENTION

Accordingly, the primary objective of the present invention is to provide a flexible flat cable connector having a more reliable means for connecting the flexible flat cable and the connector, so that EMI disturbances can be reduced and the grounding effect can be assured through more reliable electric contact.

The secondary objective of the present invention is to provide a flexible flat cable connector having a specially designed upper plate which largely enhances the electric contact between the connector and the flexible flat cable so that the effects of reducing EMI disturbances and grounding can be further assured. The upper plate also secures the connector from falling off the flexible flat cable.

The various objects and advantages of the present invention will be more readily understood from the following detailed description when read in conjunction with the appended drawings.

DETAILED DESCRIPTION OF THE PREFERRED EMBODIMENTS

Referring to FIGS. 2–7, a flexible flat cable connector according to the present invention is illustrated, which is applied to the electric connection of flexible flat cables in compact electronic appliances. The flexible flat cable connector comprises an upper plate 4, a base plate 5 and an insulating member 6 clipping a flexible flat cable 7.

Figure 1:
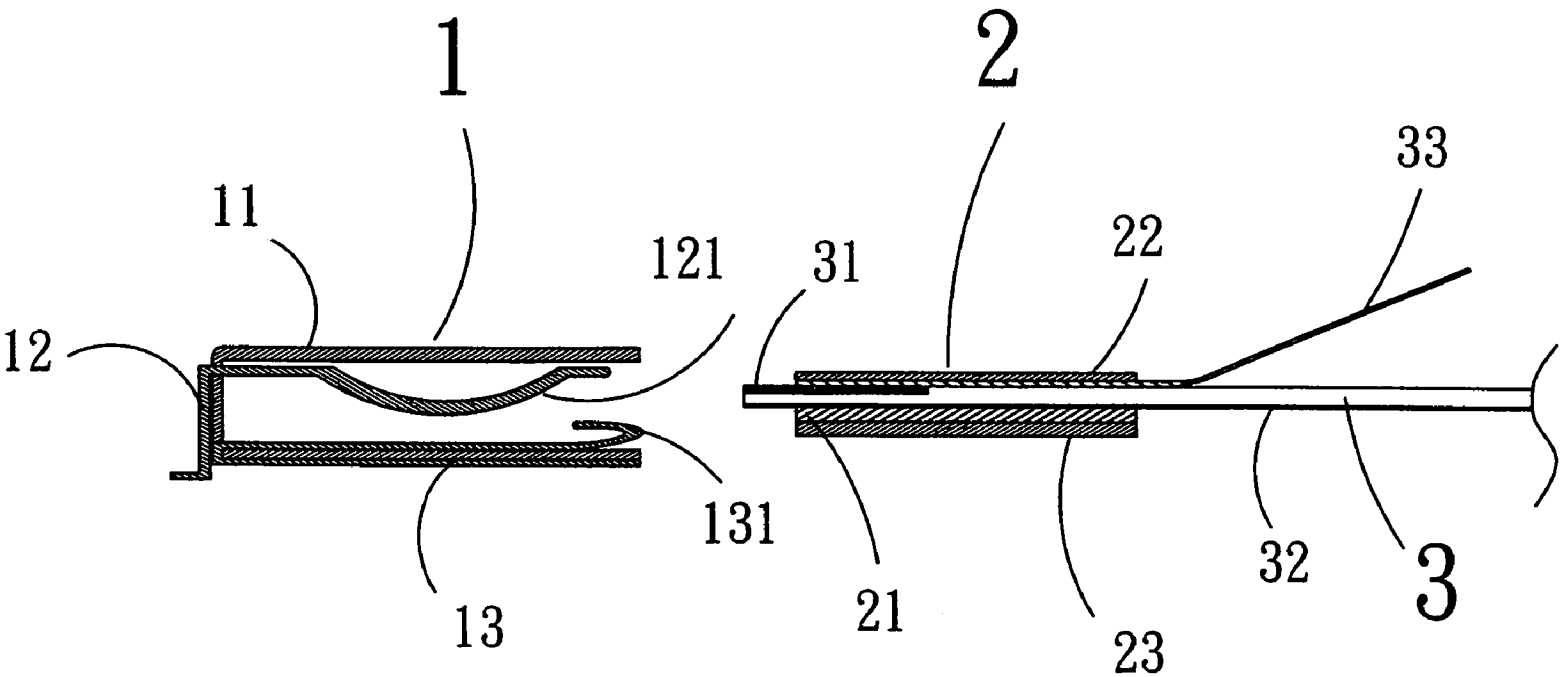
Fig. 1 (PRIOR ART)
FIG. 1 is an exploded perspective view of a flexible flat cable connector of the prior art.
Figure 2:
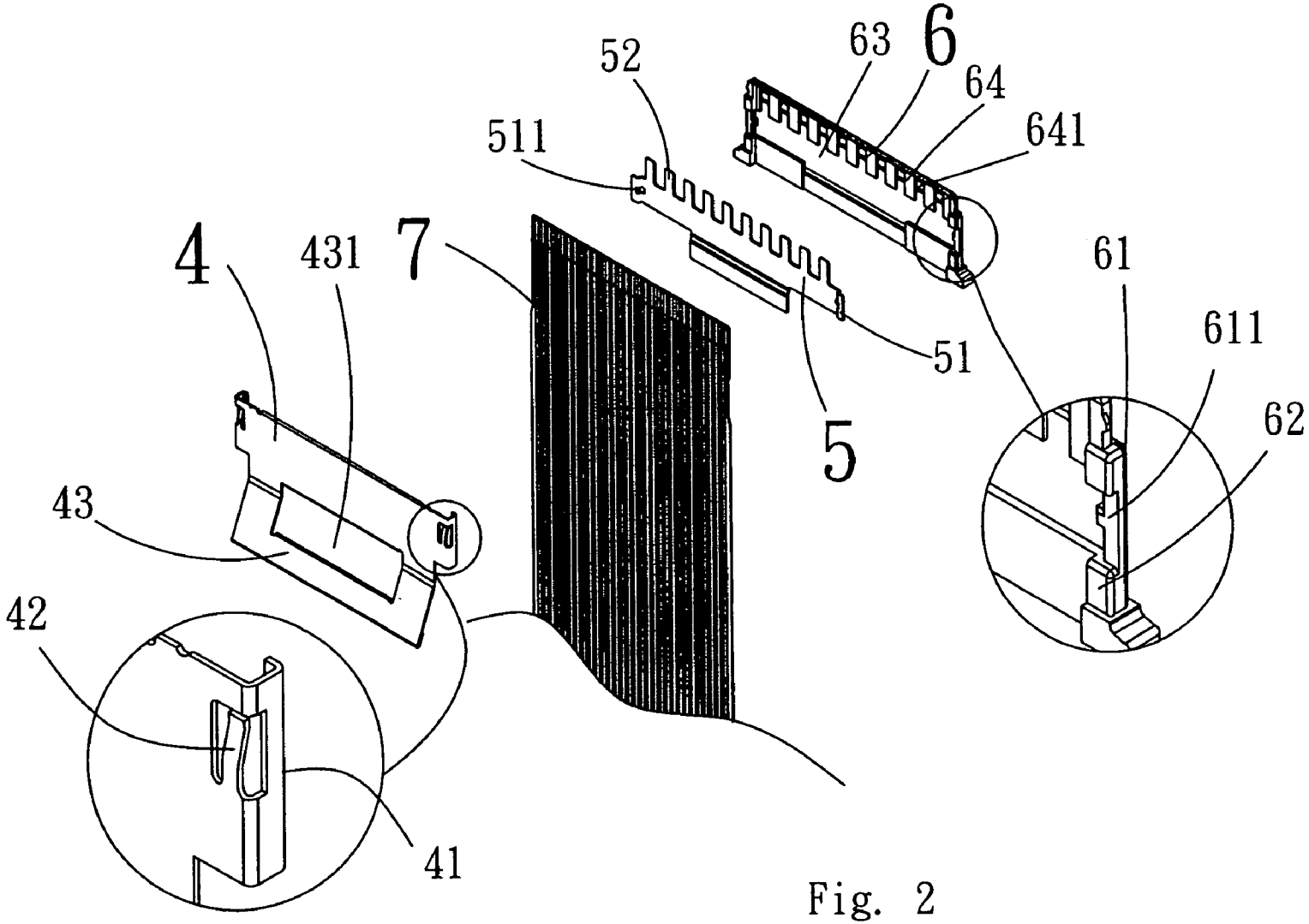
FIG. 2 is an exploded perspective view of a flexible flat cable connector according to the present invention.
Figure 3:
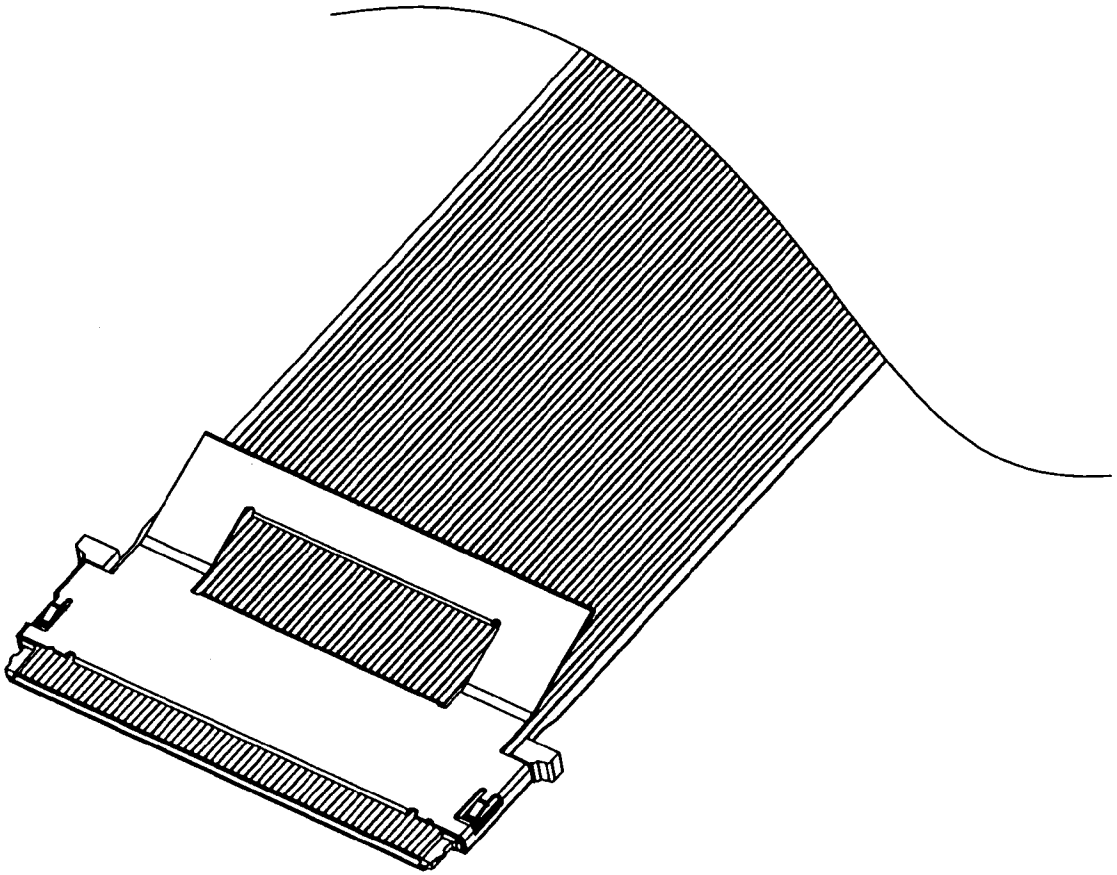
FIG. 3 is a perspective view of the flexible flat cable connector according to the present invention.
Figure 4:
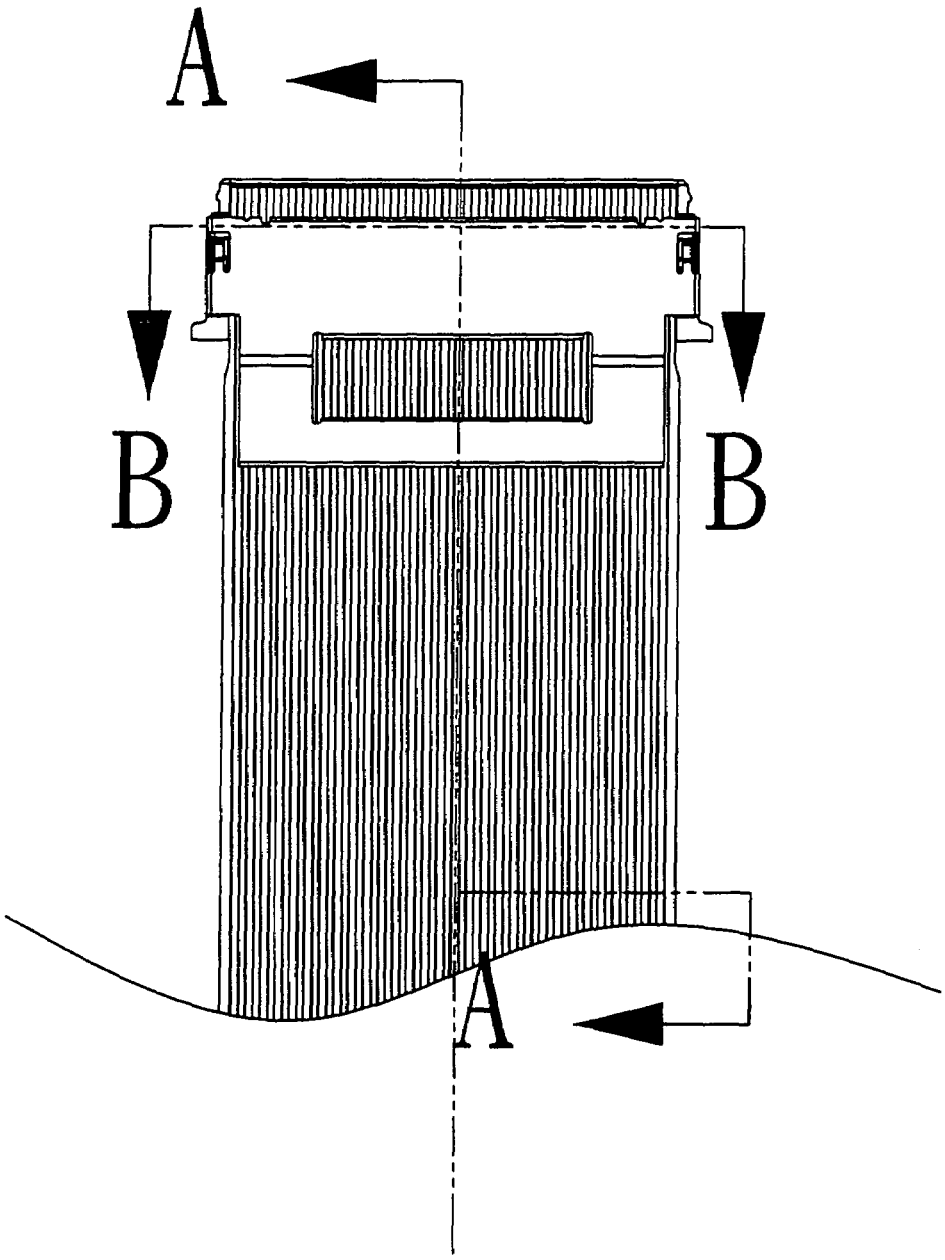
FIG. 4 is a top view of the flexible flat cable connector according to the present invention.
Figure 5:
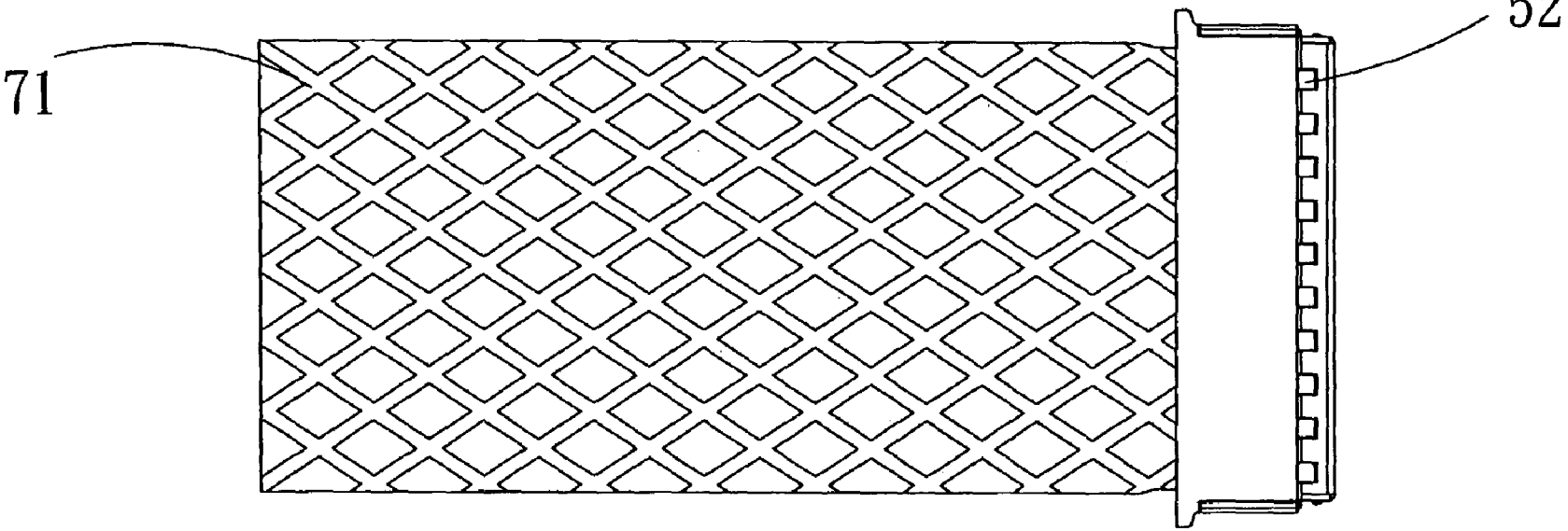
FIG. 5 is a bottom view of the flexible flat cable connector according to the present invention.
Figure 6:
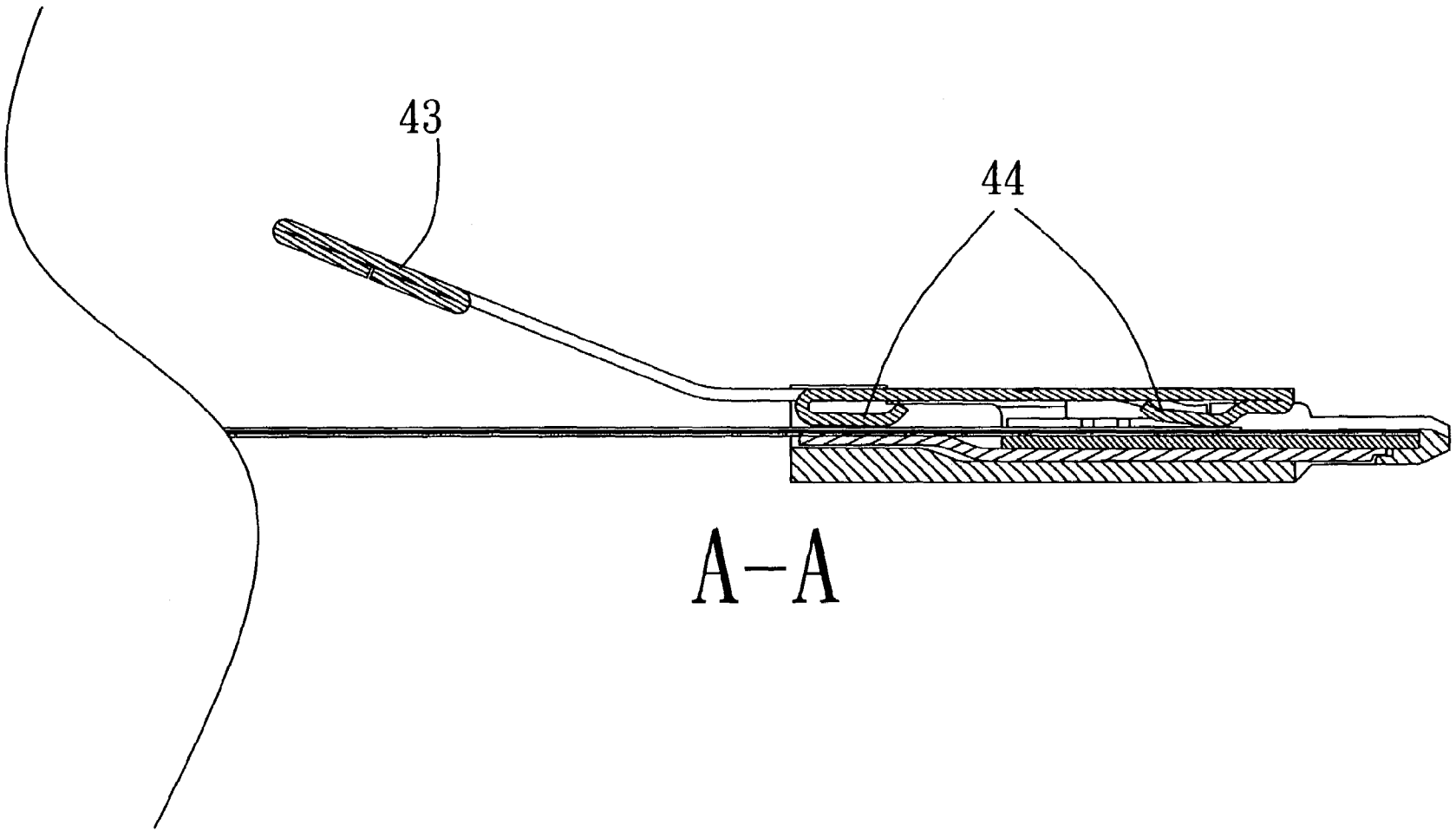
FIG. 6 is a longitudinal cross-sectional view of the flexible flat cable connector according to the present invention.
Figure 7:
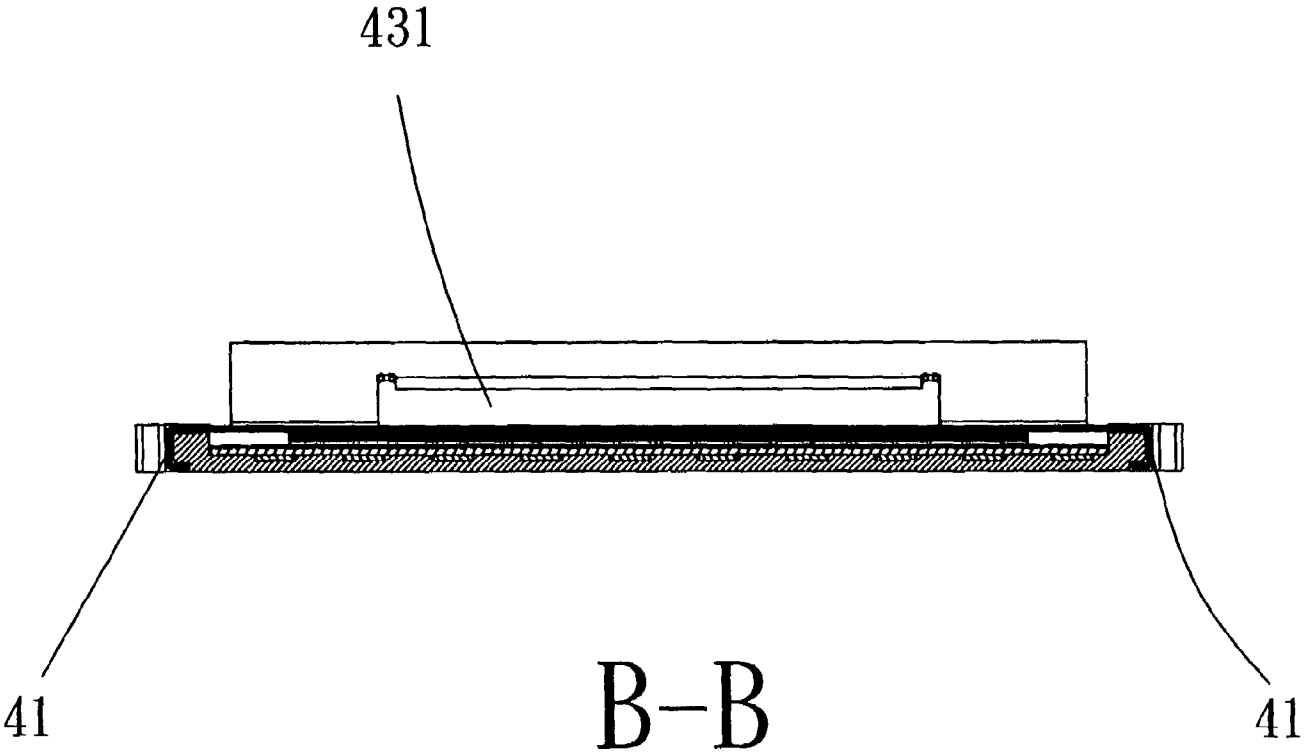
FIG. 7 is a transverse cross-sectional view of the flexible flat cable connector according to the present invention.
Figure 8:
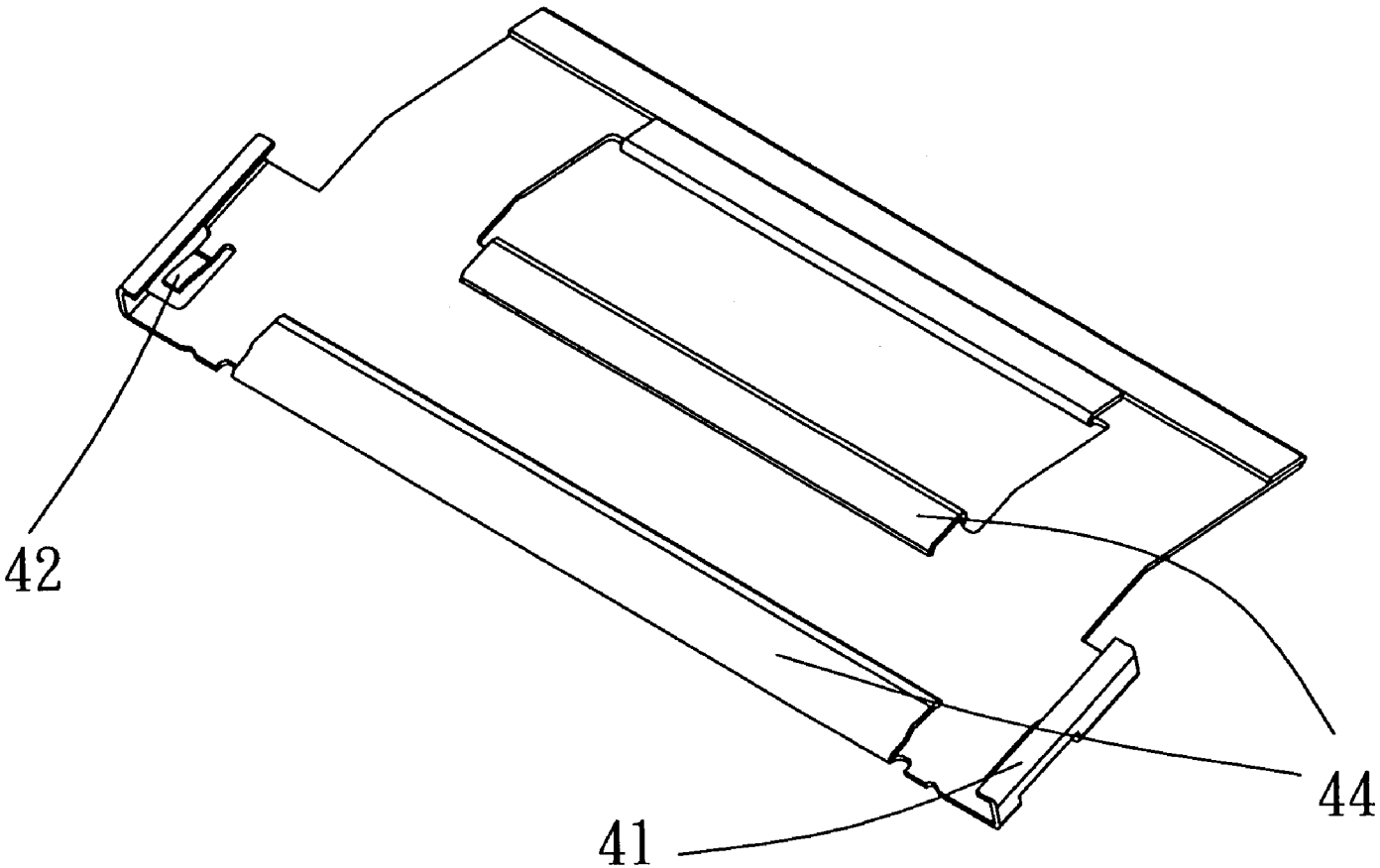
FIG. 8 is a perspective view of the upper plate of the flexible flat cable connector according to the present invention.

The upper plate 4, made of a selected metallic material, has two sidewalls 41 respectively on two lateral sides thereof. The backside of the upper plate 4, is provided with a pulling member 43 extending obliquely. An opening 431 is formed between the pulling member 43 and the upper plate 4. Close to each of two lateral sides of the upper plate 4, there is a resilient arm 42. The cross-section across the side walls 41 and the upper plate 4 takes a U shape, suitable for connecting the insulating member 6 in a sliding fashion. Referring to FIG. 8, the bottom side of the upper plate 4 is provided with two parallel retaining strips 44.

The base plate 5, also made of a metallic material, has two projected ears 51 respectively on two lateral sides thereof. The front edge of the base plate 5 is further provided with a multitude of spring fingers 52. Each of the lateral sides of the base plate 5 is further provided with a retaining hole 511.

The insulating member 6, made of an insulating material, has two flanks 61, each formed on one of two lateral side thereof and having an indentation 611. The front edge of the insulating member 6 corresponding to the aforesaid row of spring fingers 52 is provided with a multitude of spring finger slots 64, each having a through hole 641. Further, the space defined by four sides of the insulating member 6 forms a depressed receptacle 63, and the inner facing sides of the flanks 61 are each provided with a retaining block 62 corresponding to one of the retaining holes 511.

The bottom side of the flexible flat cable 7 is provided with a conductive meshed surface 71 for the reduction of EMI disturbances.

The base plate 5 is disposed on the insulating member 6, with the projected ears 51 thereon engaged with the flanks 61 of the insulating member 6; thereby, the retaining holes 511 are intervened by the retaining blocks 62 to achieve a retaining effect. Further, in such an engagement, the spring fingers 52 can extend into the corresponding spring finger slots 64 and hide within the through holes 641. At the same time, the base plate 5 is also aligned with the depressed portion of the receptacle 63, whereby the flexible flat cable 7 can be retained therein.

The flexible flat cable 7 is disposed between the base plate 5 and the projected ear 51 and is therefore aligned with the receptacle 63, so that it can get clipped between the upper plate 4 and the base plate 5 (this will be described in detail later). The conductive meshed surface 71 of the flexible flat cable 7 is in electric contact with the base plate 5.

The upper plate 4 is slidably connected to the insulating member 6 from its front edge to its rear edge, which is realized through the flanks 61 of the insulating member 6 being clipped by the U shaped cross-section formed by the upper plate 4 and its lateral walls 41. Being connected, the resilient arms 42 of the upper plate 4 are disposed within the indentations 611 and in electric contact with the projected ears 51 to achieve a grounding effect. The resilient arms 42 provide an extra effect of restricting the upper plate 4 from sliding backward, since the free ends of the resilient arms 42 tilt against the inner wall of the indentations 611 in a direction opposite to that of the sliding direction.

The upper plate 4 can be further provided with a pair of retaining strips 44 for retaining the flexible flat cable 7 between the upper plate 4 and the base plate 5. The retaining strips 44 can be further provided with terminals of electric contact for connecting the flexible flat cable 7. Therefore, the retaining strips 44 not only strengthen the engagement of the flexible flat cable 7 with the base plate 5 but also enhance electric contact of the connector. To provide the flexible flat cable connector with a better pull-resisting effect, the bottom surface of the flexible flat cable 7 may have a bulged portion for engaging the receptacle 63 of the insulating member 6, whereby the bulged portion can be secured within the depressed space between two projected ears 51 of the base plate 5. Since the base plate 5 is already secured on the connector, the flexible flat cable 7 is thus more stably secured.

As the connector of the present invention is inserted into the socket 1, the mating portions 131 of the lower terminal 13 of the socket 1 extend upwardly into the through holes 641 of the insulting member 6. Each of the mating portions 131 is brought into contact with a corresponding spring finger 52 of the base plate 5, and it can further be secured within a corresponding through hole 641 for enhancing the slide-resisting effect of the connector along the socket 1. The pulling member 43 of the upper plate 4 can be handled by a hand to assist the insertion of the connector into the socket 1, and the opening 431 on the pulling member 43 can also to handle to unplug the connector from the socket 1.

Therefore, the flexible flat cable 7 is firmly clipped by the flexible flat cable connector of the present invention, and the adhesive means for connection of the prior art is not necessary, and therefore the disadvantages associated with such means are prevented. The present invention utilizes resilient arms 42 of an upper plate 4 to contact a base plate 5 electrically, and the base plate 5 also has an electric contact with the flexible flat cable 7; a reliable grounding effect is therefore achieved. The electric connection between the base plate 5 and the conductive meshed surface 71 of the flexible flat cable 7 not only provides such a grounding effect for reducing EMI disturbances. The clipping mechanism between the connector and the flexible flat cable 7 also toughens the structural integrity of the flexible flat cable connector, largely reducing faults in electric connection.

Figure 9:
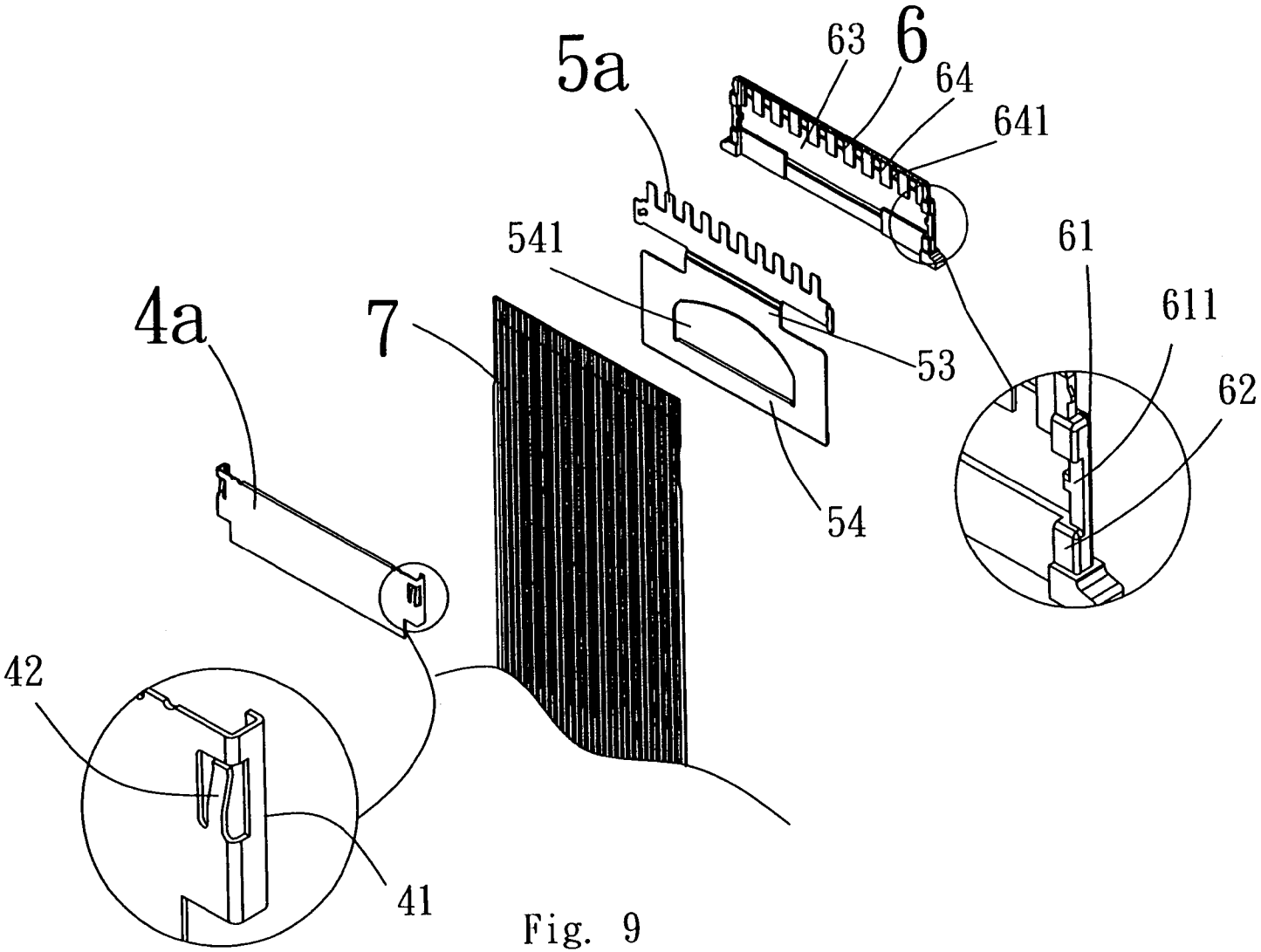
FIG. 9 is an exploded perspective view of another preferred embodiment as a flexible flat cable connector according to the present invention.

Referring to FIG. 9, another preferred embodiment of the present invention as a flexible flat cable connector has an upper plate 4*a* without a pulling member 43. A pulling member 54 is formed on the base plate 5*a*. There is a fold portion 53 between the base plate 5*a* and the pulling member 54. The pulling member 54 is further provided with an indentation 541.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A flexible flat cable connector, for electrically engaging a socket having an upper terminal and a lower terminal, comprising:

an insulating member having an indentation and an adjacent retaining block on each of two lateral sides of said insulating member, said insulating member further including a multitude of spring finger slots along a front edge thereof;

a base plate mounted on said insulating member having two projected ears respectively on two lateral sides of said base plate, each of said projected ears extending into a corresponding said indentation and having a retaining hole for retaining a corresponding retaining block, said base plate further including a multitude of spring fingers capable of being contained within said spring finger slots; and an upper plate capable of being slidably connected to said insulating member for covering said base plate, said upper plate having two side walls for holding said insulating member, each of said side walls further including a resilient arm in electric contact with a corresponding said projected ear and extending into a corresponding said indentation;

whereby said upper plate and said base plate clips a flexible flat cable that has a conductive meshed layer on a bottom surface thereof, whereby said base plate is in electric contact with said conductive meshed layer and said resilient arms of said upper plate is in contact with said base plate so as to achieve a grounding effect, and whereby said flexible flat cable connector is inserted into said socket and mating portions of said lower terminal of said socket extends into through holes of said insulating member.

2. The flexible flat cable connector of claim 1 wherein a central portion of said insulating member forms a receptacle so as to retain said base plate by intervening with the motion of said base plate.

3. The flexible flat cable connector of claim 2 wherein said base plate has a depressed portion corresponding to said receptacle for retention, and a bottom surface of said flexible flat cable is provided with a bulged portion corresponding to said depressed portion.

4. The flexible flat cable connector of claim 1 wherein said insulting member is further provided with a multitude of spring finger slots corresponding to said multitude of spring fingers, each of said spring finger slots having a through hole for housing a corresponding said spring finger.

5. The flexible flat cable connector of claim 1 wherein each of said indentations on said insulting member is provided with a retaining block, and each of said projected ears is provided with a retaining hole corresponding to a said retaining block for retention.

6. The flexible flat cable connector of claim 1 wherein said upper plate and said side walls thereof form a U-shaped cross-section.

7. The flexible flat cable connector of claim 1 wherein said upper plate has a pulling member tilted backward, and an opening is formed between said upper plate and said pulling member.

8. The flexible flat cable connector of claim 1 wherein said upper plate further includes a pair of parallel retaining strips for holding said flexible flat cable.

9. The flexible flat cable connector of claim 1 wherein a rear edge of said base plate is provided with a pulling member tilted backward, and an opening is formed between said base plate and said pulling member.

* * * * *